US006105963A

United States Patent [19]

Dontfraid

[11] Patent Number: 6,105,963

[45] Date of Patent: Aug. 22, 2000

[54] APPARATUS AND METHOD FOR PLAYING A GOLF BOARD GAME

[76] Inventor: Franklyn F. Dontfraid, 1400 Mason Ave., Daytona Beach, Fla. 32114

[21] Appl. No.: 09/154,687

[22] Filed: Sep. 17, 1998

[51] Int. Cl.[7] ..... A63F 3/00

[52] U.S. Cl. ..... 273/245

[58] Field of Search ..... 273/245, 146

[56] References Cited

U.S. PATENT DOCUMENTS

| | | | |
|---|---|---|---|
| 1,638,365 | 8/1927 | Ryan | 273/245 |
| 3,771,792 | 11/1973 | Crumlish | 273/245 |
| 3,910,581 | 10/1975 | Nicholson | 273/245 |
| 4,042,246 | 8/1977 | Strandgard | 273/245 |
| 4,106,774 | 8/1978 | Seguin | 273/245 |
| 4,113,260 | 9/1978 | Sain | 273/245 |
| 4,277,065 | 7/1981 | White | 273/245 |
| 4,331,333 | 5/1982 | Willcocks | 273/238 |
| 4,364,569 | 12/1982 | Duwell et al. | 273/245 |
| 4,759,548 | 7/1988 | Chaban | 273/245 |
| 5,413,349 | 5/1995 | Canther | 273/245 |

FOREIGN PATENT DOCUMENTS

| | | | |
|---|---|---|---|
| 229209 | 2/1925 | United Kingdom | 273/245 |
| 2171607 | 9/1986 | United Kingdom | 273/245 |

*Primary Examiner*—Benjamin H. Layno
*Attorney, Agent, or Firm*—Paul S. Rooy

[57] ABSTRACT

An apparatus and method for playing a golf board game. The apparatus comprises a plurality of game boards depicting golf holes, playing pieces, a color die, a windage die, a pair of green conventional dice, and three conventional dice. Playing pieces are taught comprising a golf club and a golf ball rigidly attached to a base. During play, each player chooses a club, and rolls a specified combination of the dice, moving his playing piece toward the hole accordingly. After all players have completed a hole, the next game board is used, until all game boards have been used. The winner is determined conventionally via either match or stroke play scoring. A golf board game box is also disclosed which conveniently stores the unused game boards, and securely holds a game board being used for play on a game box upper surface.

13 Claims, 3 Drawing Sheets

APPARATUS AND METHOD FOR PLAYING A GOLF BOARD GAME

BACKGROUND OF THE INVENTION

1. Field of the Invention

This invention relates to golf games, and in particular to an apparatus and method for playing a golf board game.

2. Background of the Invention

It is generally accepted that golf first emerged in Scotland around 1100 AD. It was based on a Roman game called paganica, which used a bent stick and a leather ball stuffed with feathers. Golf was banned in Scotland from 1457 until 1502 by King James II because its popularity threatened archery practice, which was necessary for national defense. In 1502 England and Scotland signed a treaty of perpetual peace, and the play of golf resumed.

Until 1848 golf was played with a feather-stuffed leather ball called "the feathery". In 1848 golfers started using a solid gutta-percha ball called "the gutty", and in 1899 an American inventor introduced the liquid-center golf ball.

The oldest golf club in continuous existence is the Ancient Golf Club of St. Andrews, located in Edinburgh, Scotland (established 1744). This club established many of the standards of the game, including fixing the length of the course at 18 holes. The Royal Montreal Golf Club was established in 1873, and ranks as the oldest North American golf club. In the United States, the St. Andrews Golf Club was established in Yonkers, N.Y. in 1888, and was the first United States golf club.

Today, more people play golf than any other outdoor sport. More than 16 million people play golf in the United States alone every year. The game has become popular in many places, including the United States, Canada, England, Western Europe, and Japan.

Conventional golf courses feature either nine or 18 holes. A round of golf consists of 18 holes played in a predetermined sequence. During play, golfers attempt to keep the ball on the fairway, a stretch of mowed grass between the tee-off site and the putting green, which contains II the hole into which the ball must be sunk. The edges of the fairways frequently have obstacles called bunkers. These bunkers may be a mound or a sand trap, or sometimes a body of water such as a stream, pond, lake, river or ocean.

About half the holes of an 18-hole course are medium holes, and measure from approximately 280–455 yards in length. The other holes are divided between short holes (less than 280 yards) and long holes (longer than 485 yards). Consequently, 18-hole golf courses occupy between 90 and 250 acres.

The large area of ground required for golf courses gives rise to one major problem faced by the sport: space within which to locate golf courses. This problem is especially pronounced in countries where real estate is scarce, such as Japan.

Another problem associated with playing golf is the travel involved in getting to the golf course to start out with. Golf courses are typically located outside cities, in the countryside. Individuals desiring to play must first travel from their homes or workplaces to the location of the golf course.

Thus the need exists for a realistic golf board game, whereby the players may practice the mechanics of playing a game of golf, and a the same time amuse themselves, using an apparatus that can readily fit on the average kitchen table.

SUMMARY OF THE INVENTION

Accordingly, it is an object of the present invention to provide an apparatus and method for playing a golf board game which only requires a small amount of space. Design features allowing this object to be accomplished include a plurality of game boards and playing pieces, a color die, a windage die, and three conventional dice. Advantages associated with the accomplishment of this object include the ability to practice the mechanics of playing golf without having to travel to a golf course, and amusement of the players.

It is another object of this invention to provide an apparatus and method for playing a golf board game which simulates the effect of wind on a shot. A design feature enabling the accomplishment of this object is a windage die. An advantage associated with the realization of this object is increased realism.

It is another object of this invention to provide an apparatus and method for playing a golf board game which simulates the effect of different golf clubs on a shot. A design feature enabling the accomplishment of this object is the inclusion of rules assigning a club yardage value to each club. An advantage associated with the realization of this object is increased realism.

It is still another object of this invention to provide an apparatus and method for playing a golf board game which is simple to use, and whose rules of use are easily understood. Design features enabling the accomplishment of this object include a plurality of easy-to understand game boards, and simple, intuitive rules. An advantage associated with the realization of this object is retaining the interest of young players.

It is another object of this invention to provide an apparatus and method for playing a golf board game which includes a means for conveniently storing and using game boards. Features allowing this object to be accomplished include a golf board game box comprising a storage void, and an upper surface bounded on three sides by upper surface walls. Benefits associated with reaching this objective include increased convenience in transporting and storing the golf board game.

It is yet another object of this invention to provide an apparatus and method for playing a golf board game which is inexpensive and readily available. Design features allowing this object to be achieved include the use of components made of inexpensive and readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIGS. 2 and 3. Sheet three contains FIGS. 4 and 5.

DETAILED DESCRIPTION OF THE PREFERRED EMBODIMENT

Figure 1:
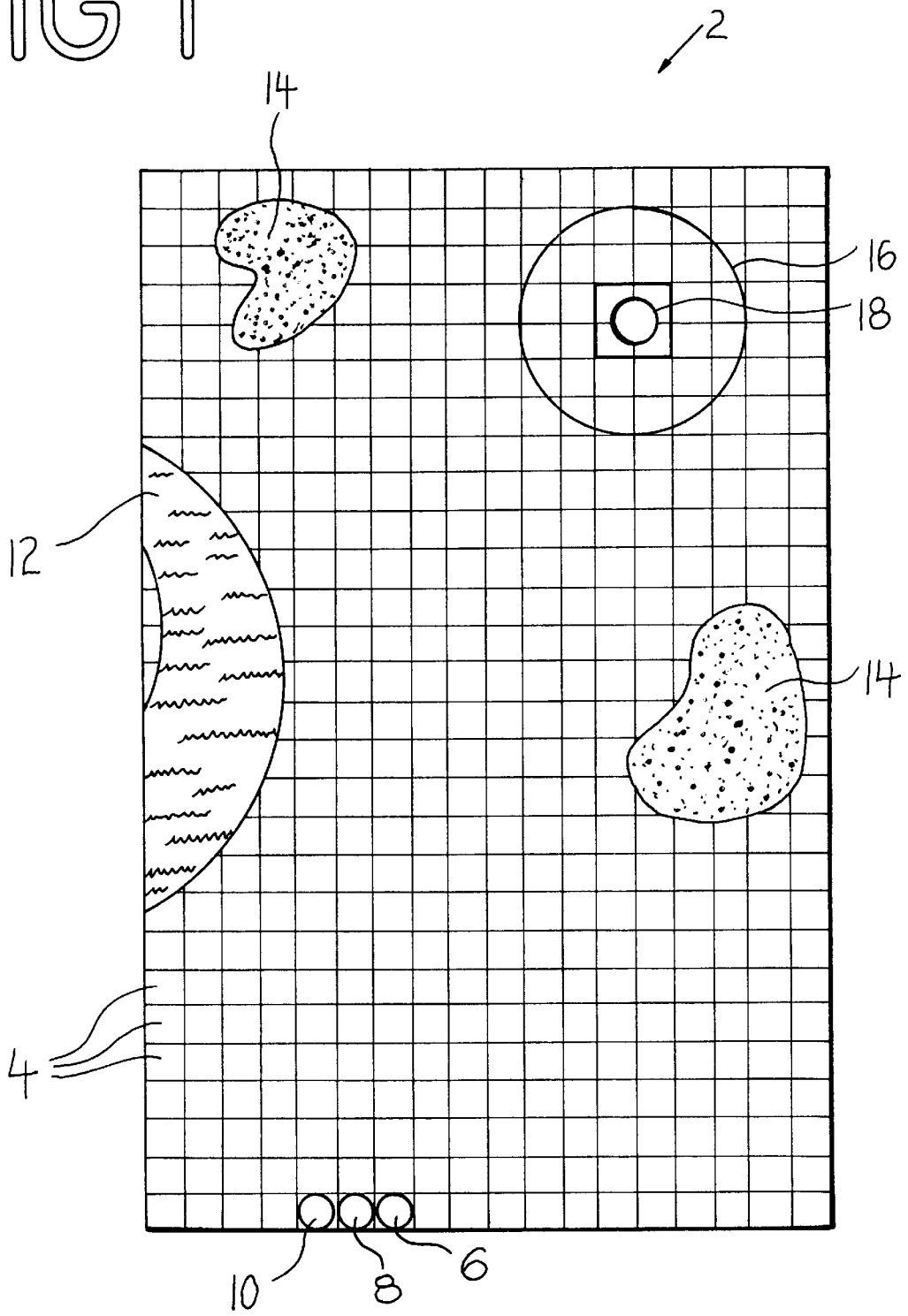
FIG. 1 is a top plan view of a game board.

The instant game comprises a plurality of game boards 2—generally either nine or eighteen in number, mirroring the number of holes in a conventional golf course. The game boards 2 are played in order, as identified by the hole 18 number on the board. In addition, the instant game comprises a plurality of playing pieces 20 (three, in the preferred embodiment), a color die 28, a windage die 36, and three conventional dice.

FIG. 1 is a top plan view of game board 2 having hole #3. Game board 2 comprises squares 4 arranged in columns and rows. Game board 2 further comprises red start square 10, green start square 8 and yellow start square 6 disposed at an extreme of game board 2 opposite a hole 18 surrounded by a green 16. Hole 18 is identified by number to specify its correct sequential position for play. Game board 2 also comprises water hazard 12 and sand traps 14. Other features associated with golf courses, such as houses, bridges, beaches, rivers, trees, golf carts, etc., may also be graphically depicted on game board 2.

Golf course holes typically measure from 280 to 455 yards long. Each square 4 not part of green 16 represents measures 10 yards by 10 yards, except when playing with a putter within three squares of green 16, in which case each square measures 1 yard by 1 yard. Thus, the game boards 2 of the instant game range in length from approximately 22 squares to approximately 50 squares. Each square 4 disposed within green 16 measures 1 yard by 1 yard. Any square 4 through which the boundary line of green 16 passes is considered part of green 16. Any square 4 through which the line defining hole 18 passes is considered part of hole 18.

Figure 2:
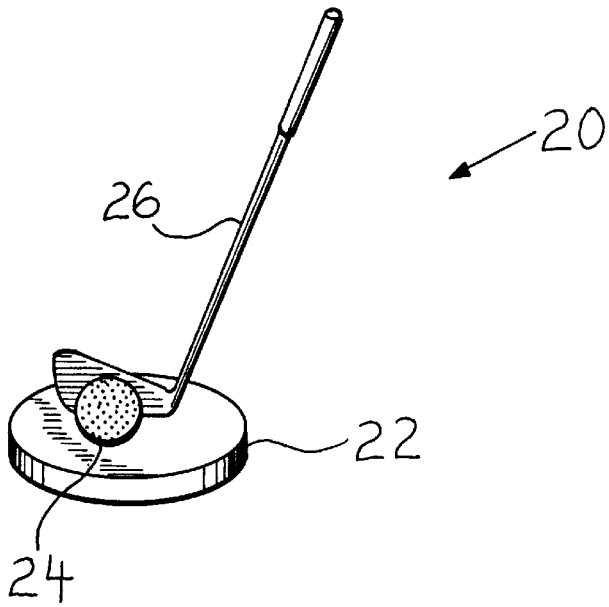
FIG. 2 is a front isometric view of a playing piece.

FIG. 2 is a front isometric view of playing piece 20. The game comprises a plurality of playing pieces 20. In the preferred embodiment, the instant game included three playing pieces 20. Each playing piece 20 comprises golf club 26 and golf ball 24 rigidly attached to base 22.

Figure 3:
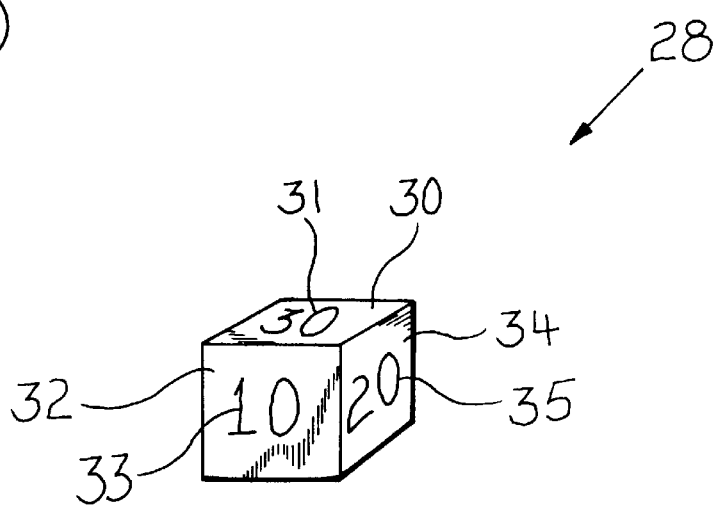
FIG. 3 is a front isometric view of a color die.

FIG. 3 is a front cross-sectional view of color die 28. Color die 28 is a regular cube comprising two red faces 30, two green faces 32, and two yellow faces 34. Each red face 30 is marked with a red face bonus 31. Each green face 32 is marked with a green face bonus 33. Each yellow face 34 is marked with a yellow face bonus 35.

Figure 4:
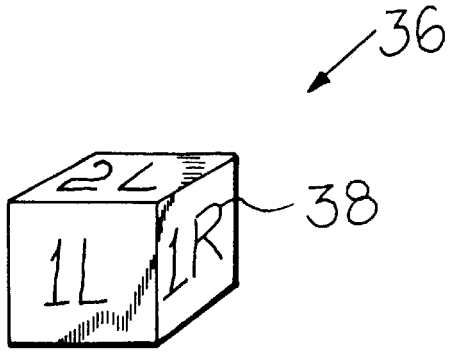
FIG. 4 is a front isometric view of a windage die.

FIG. 4 is a front cross-sectional view of windage die 36. Windage die 36 is a regular cube comprising windage die indicia 38. One example of the indicia might be as follows: 1L, 1R, 2L, 2R, 3L, and 3R marked on the six sides of windage die 36 respectively.

Figure 5:
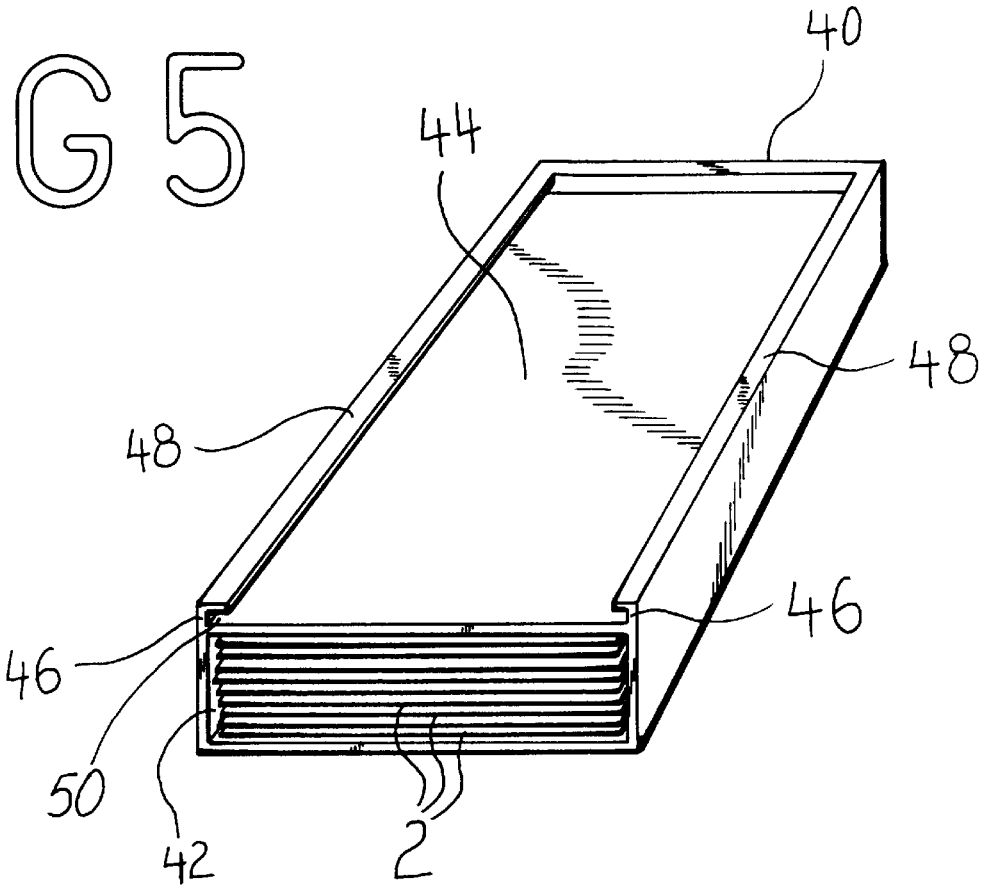
FIG. 5 is a front isometric view of a golf board game box.

FIG. 5 is a front isometric view of golf board game box 40. Golf board game box 40 comprises storage void 42 and an upper surface 44. Upper surface 44 is bounded on three sides by upper surface walls 46. A pair of opposing upper surface walls 46 terminate in upper surface wall lip 48. This pair of opposing upper surface walls 46 and their respective upper surface wall lips 48, together with upper surface 44, define upper surface slot 50. Upper surface slot 50 is sized to admit a game board 2. Storage void 42 is sized to admit a plurality of game boards 2. In this fashion, the game boards 2 which are not in use may be conveniently stored within storage void 42. A game board 2 being used for play may be inserted into upper surface slot 50, and there be held securely for the convenience of the players during play.

Method of Play:

A. Each player chooses a club and rolls dice to advance his playing piece 20.

B. Golf club yardage values are as follows: Driver=70 yards; #5 Iron=50 yards; #7 Iron=30 yards; #9 Iron=10 yards; and Putter=0 yards.

C. Playing pieces 20 advance by rolling some combination of the following dice: color die 28 (first move only), one or two or three conventional dice (at the player's discretion), windage die 36, and within three squares 4 of green 16, one or two green conventional dice. The following dice and clubs may be used during play:

First Shot: Only the driver may be used. The color die, the windage die, and one, two, or three conventional dice must be used. Score=70 yards+color die bonus+the total of one or two or three conventional dice multiplied by 10 yards+windage die value. All squares moved must be in the same column, except the windage die value must be along the row corresponding to the color start square indicated by the color die, except the playing piece is moved left (L) or right (R) the number of squares indicated by the windage die.

Second Shot: Only the #5 Iron, #7 Iron, or the #9 Iron may be used. The color die, the windage die, and one, two, or three conventional dice must be used. Score=golf club yardage value+color die bonus+the total of one or two or three conventional dice multiplied by 10 yards+windage die value. The playing piece may be moved forward (along a column away from the start squares), sideways (along a row), or diagonally.

Third Shot: Only a club number not yet used, selected from the #5 Iron, #7 Iron, or the #9 Iron may be used. The windage die, and one, two, or three conventional dice must be used. The color die may be used at the player's option. Score=golf club yardage Value+color die bonus+the total of one or two or three conventional dice multiplied by 10 yards+windage die value. The playing piece may be moved forward (along a column away from the start squares), sideways (along a row), or diagonally.

Fourth Shot: Same as the third shot, except no golf club yardage is included in the shot distance computation. The playing piece may be moved forward (along a column away from the start squares), sideways (along a row), or diagonally.

Fifth and Subsequent Shots: Same as the fourth shot.

Green Play: When a player is within three squares of the green, green play rules apply at the player's option. When a player is within the green, green play rules apply. Green Play Rules: Each player rolls two green conventional dice, and moves his playing piece the number of squares indicated on either die, or the sum of both dice, at that player's option. The windage die may used at the player's option. The playing piece may be moved forward (along a column away from the start squares), backwards (along a column toward the start squares), sideways (along a row), or diagonally.

D. If a shot lands a playing piece off the game board, the playing piece is returned to the position from which the shot was made, and the shot is forfeited.

E. When all playing pieces have arrived at the hole, the next playing board is played.

F. After all playing boards have been played, the winner is determined conventionally via either match or stroke scoring.

G. Optionally, players may be penalized 20 yards for landing in a sand trap, or 30 points for landing in a waterway. These penalty points are subtracted from the players next shot.

While a preferred embodiment of the invention has been illustrated herein, it is to be understood that changes and variations may be made by those skilled in the art without departing from the spirit of the appending claims.

| DRAWING ITEM INDEX | |
|---|---|
| 2 | game board |
| 4 | square |
| 6 | yellow start square |
| 8 | green start square |
| 10 | red start square |
| 12 | water hazard |
| 14 | sand trap |
| 16 | green |
| 18 | hole |
| 20 | playing piece |
| 22 | base |
| 24 | golfball |
| 26 | golfclub |
| 28 | color die |
| 30 | red face |
| 31 | red face bonus |
| 32 | green face |
| 33 | green face bonus |
| 34 | yellow face |
| 35 | yellow face bonus |
| 36 | windage die |
| 38 | windage die indicia |
| 40 | golfboard game box |
| 42 | storage void |
| 44 | upper surface |
| 46 | upper surface wall |
| 48 | upper surface wall lip |
| 50 | upper surface slot |

I claim:

1. A golf board game apparatus comprising a plurality of game boards, a plurality of playing pieces, a color die, a windage die, and a plurality of conventional dice, each said game board comprising a plurality of squares disposed in columns and rows, a plurality of start squares at one extreme of said game board and a hole surrounded by a green at an opposite extreme of said game board, each said start square having one of at least three different colors, each said start square having a different color, said color die comprising color die faces having at least said three different colors, each said die face having a single color, each said color die face bearing a bonus number, said windage die comprising windage die faces bearing indicia specifying right and left wind drift.

2. The golf board game apparatus of claim 1 further comprising a pair of green conventional dice whereby players may advance their playing pieces within three squares of said green.

3. The golf board game apparatus of claim 2 wherein each said game board further comprises at least one water hazard, whereby game realism is enhanced.

4. The golf board game apparatus of claim 3 wherein each said game board further comprises at least one sand trap, whereby game realism is enhanced.

5. The golf board game apparatus of claim 2 wherein said color die comprises two red faces, two green faces and two yellow faces, said faces bearing a red face bonus, a green face bonus and a yellow face bonus respectively, and wherein said start squares comprise one red start square, one green start square, and one yellow start square.

6. The golf board game apparatus of claim 5 wherein said windage die indicia include the marks "1L", "2L", "3L", "1R", "2R" and "3R".

7. The golf board game apparatus of claim 1 wherein each said playing piece comprises a golf club and a golf ball rigidly attached to a base.

8. The golf board game apparatus of claim 1 further comprising a golf board game box, said golf board game box comprising a storage void sized to admit and store said plurality of game boards, and an upper surface bounded on three sides by upper surface walls, two opposite said upper surface walls terminating in an upper surface wall lip, said upper surface, said two opposite upper surface walls and their respective upper surface wall lips defining an upper surface slot, whereby one said game boards may be securely held in place on said upper surface for convenience of play.

9. A method of playing a golf board game using a golf board apparatus comprising a plurality of game boards, a plurality of playing pieces, a color die, a windage die, a pair of green conventional dice, and a plurality of conventional dice, each said game board comprising a plurality of squares disposed in columns and rows, a plurality of start squares at one extreme of said game board and a hole surrounded by a green at an opposite extreme of said game board, each said start square having one of at least three different colors, each said start square having a different color, said color die comprising color die faces having at least said three different colors, each said die face having a single color, each said color die face bearing a bonus number, said windage die comprising windage die faces bearing indicia specifying right and left wind drift, said method comprising the steps of:

A. Rolling said color die to determine each player's start square and shot bonus yardage, and each player placing a playing piece on a start square corresponding to the roll of the color die;

B. Choosing a golf club for each shot (golf club yardage values are as follows: Driver=70 yards; #5 Iron=50 yards, #7 Iron=30 yards, #9 Iron=10 yards; and Putter=0 yards);

C. Advancing said playing pieces by rolling some combination of said color die, one or two or three said conventional dice (at the player's discretion), said windage die, and within three said squares of said green said two green conventional dice;

D. For a first shot using only said driver, and using only said color die, said windage die, and one, two, or three conventional dice, and said first shot score=70 yards+color die bonus+a total of one or two or three conventional dice multiplied by 10 yards+windage die value, and moving all squares in said first shot in a same column, except said windage die value must be moved along a row, left (L) or night (R) the number of squares indicated by said windage die;

E. For a second shot using only said #5 Iron, #7 Iron, or the #9 Iron, and using only said color die (at a player's option) and said one, two, or three conventional dice and said windage die, and said second shot score=golf club yardage value+color die bonus (if used)+a total of one or two or three conventional dice multiplied by 10 yards+windage die value, and moving all squares forward (along a column away from said start squares), sideways (along a row), or diagonally;

F. For a third shot using only a club number not yet used, selected from the #5 Iron, #7 Iron, or the #9 Iron, and using only said color die (at a player's option), said one, two, or said three conventional dice, and said windage die (at a player's option), and said third shot score=golf club yardage value+color die bonus (if used)+a total of one or two or three conventional dice multiplied by 10 yards+windage die value (if used), and moving all squares forward (along a column away from said start squares), sideways (along a row), or diagonally;

G. For a fourth shot playing same as in said Third Shot, except including no golf club yardage in a shot distance computation;

H. For a fifth and subsequent shots playing same as said Fourth Shot; and

I. When a playing piece is within three said squares of said green, said playing piece may optionally play in accordance with green play rules, and when a playing piece is disposed within said green, said playing piece must play in accordance with green play rules, said green play rules comprising the steps of using the putter only, rolling said two green conventional dice, moving a playing piece a number of squares indicated on either said die, or the sum of both said dice, at a player's option, using said windage die at a player's option, and moving said playing piece forward (along a column away from said start squares), backwards (along a column toward said start squares), sideways (along a row), or diagonally.

10. The method of playing a golf board game of claim 9 comprising the further steps of:

J. Playing a next playing board after all players have finished with each board; and F. After all playing boards have been played, determining a winning player conventionally via match or stroke scoring, or points scoring with points alloted on making holes.

11. The method of playing a golf board game of claim 10 comprising the further step of returning a playing piece to a position from which a shot was made, and forfeiting such shot, where such shot landed said playing piece off said game board.

12. The method of playing a golf board game of claim 11 comprising the further steps of penalizing any playing piece landing in a sand trap 20 yards, and penalizing any playing piece landing in a waterway 30 yards.

13. A method of playing a golf board game using a golf board apparatus comprising a plurality of game boards, a plurality of playing pieces, a color die, a windage die, a pair of green conventional dice, and a plurality of conventional dice, each said game board comprising a plurality of squares disposed in columns and rows, a plurality of start squares at one extreme of said game board and a hole surrounded by a green at an opposite extreme of said game board, each said start square having one of at least three different colors, each said start square having a different color, said color die comprising color die faces having at least said three different colors, each said die face having a single color, each said color die face bearing a bonus number, said windage die comprising windage die faces bearing indicia specifying right and left wind drift, said method comprising the steps of:

A. Rolling said color die to determine each player's start square and first shot bonus yardage, and each player placing a playing piece on a start square corresponding to the roll of the color die;

B. Advancing said playing pieces by rolling some combination of said color die, one or two or three said conventional dice (at the player's discretion), said windage die, and within three said squares of said green said two green conventional dice;

C. For a first shot using only said color die, said windage die, and one, two, or three conventional dice, and said first shot score=color die bonus+a total of one or two or three conventional dice multiplied by 10 yards+windage die value, and moving all squares in said first shot in a same column, except said windage die value must be moved along a row, left (L) or right (R) the number of squares indicated by said windage die;

D. For a second shot using only and said color die (at a player's option), one, two, or three conventional dice, and said windage die, and said second shot score=color die bonus (if used)+a total of one or two or three conventional dice multiplied by 10 yards+windage die value, and moving all squares forward (along a column away from said start squares), sideways (along a row), or diagonally;

E. For a third shot using only said color die (at a player's option), one, two, or said three conventional dice, and said windage die (at a player's option), and said third shot score=color die bonus (if used)+a total of one or two or three conventional dice multiplied by 10 yards+windage die value (if used), and moving all squares forward (along a column away from said start squares), sideways (along a row), or diagonally;

F. For a fourth shot playing same as in said Third Shot;

G. For a fifth shot playing same as said Fourth Shot; and

H. When a playing piece is within three said squares of said green, said playing piece may optionally play in accordance with green play rules, and when a playing piece is disposed within said green, said playing piece must play in accordance with green play rules, said green play rules comprising the steps of rolling said two green conventional dice, moving a playing piece a number of squares indicated on either said die, or the sum of both said dice, at a player's option, using said windage die at a player's option, and moving said playing piece forward (along a column away from said start squares), backwards (along a column toward said start squares), sideways (along a row), or diagonally.

* * * * *

UNITED STATES PATENT AND TRADEMARK OFFICE

CERTIFICATE OF CORRECTION

PATENT NO. : 6,105,963
DATED : 8/22/2000
INVENTOR(S) : Dontfraid, F.

It is certified that error appears in the above-identified patent and that said Letters Patent is hereby corrected as shown below:

Col. 1 Line 39: "...contains II the hole..." *should read* "...contains the hole..."
Col. 5 Line 23: "...golfboard game box..." *should read* "...golf board game box..."
Col. 6 Line 44: "...or night (R)..." *should read* "...or right (R)...

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*